US008684050B2

(12) United States Patent
Jimroglou et al.

(10) Patent No.: US 8,684,050 B2
(45) Date of Patent: Apr. 1, 2014

(54) SPILL PROOF DRINK DISPENSING SYSTEM, KIT AND METHOD

(76) Inventors: William Jimroglou, Manahawkin, NJ (US); Daniel Noel, St. Charles, IL (US)

( * ) Notice: Subject to any disclaimer, the term of this patent is extended or adjusted under 35 U.S.C. 154(b) by 0 days.

(21) Appl. No.: 13/412,862

(22) Filed: Mar. 6, 2012

(65) Prior Publication Data

US 2013/0233438 A1 Sep. 12, 2013

(51) Int. Cl.
*B65B 1/04* (2006.01)
*B65B 3/00* (2006.01)
*B67C 3/00* (2006.01)

(52) U.S. Cl.
USPC ..... 141/383; 141/346; 141/384

(58) Field of Classification Search
USPC ..... 141/346, 360, 369, 370, 372, 383, 384
See application file for complete search history.

(56) References Cited

U.S. PATENT DOCUMENTS 4,446,673 A * 5/1984 Desthieux ..... 53/467
5,575,317 A * 11/1996 Behnke et al. ..... 141/372
5,890,629 A * 4/1999 Loew ..... 222/144.5
6,532,865 B1 * 3/2003 Hoffman ..... 99/407
7,467,650 B2 * 12/2008 Massey ..... 141/386
7,490,739 B2 * 2/2009 Prabucki ..... 222/146.6
7,640,766 B2 * 1/2010 Shelton ..... 62/389
2007/0062602 A1 * 3/2007 Alsberg et al. ..... 141/98
2007/0095864 A1 * 5/2007 Vangeel et al. ..... 222/556
2007/0131716 A1 * 6/2007 Prabucki ..... 222/146.6
2007/0187435 A1 * 8/2007 Quirk ..... 222/481

* cited by examiner

*Primary Examiner* — Timothy L Maust
*Assistant Examiner* — Brandon J Warner
(74) *Attorney, Agent, or Firm* — Matthew M. DiMaggio, Esq.; Michael J. Feigin, Esq.; Feigin & Associates, LLC

(57) ABSTRACT

Embodiments of the disclosed technology are directed towards a leak-proof drink dispensing system. The drink dispenser uses a container, a spigot that may be mated to a lid adapted to fit a corresponding cup. The spigot extends from an outside portion of the container, and has a lever, cylindrical nozzle, and threaded cylindrical locking collar. The lid has a threaded cylindrical spout that may be mated to the spigot, such that rotation of the lever causes the threads of the collar to engage the threads of the spot. This causes the lid to become releasably affixed to the spigot for purposes of leak-free dispensing of the liquid from the container. The drink dispenser may also employ a mixing rake, cooling tray, spill catching tray, and cup dispenser.

15 Claims, 9 Drawing Sheets

SPILL PROOF DRINK DISPENSING SYSTEM, KIT AND METHOD

FIELD OF THE DISCLOSED TECHNOLOGY

The disclosed technology is geared generally towards beverage storage and dispensing. More specifically, the disclosed technology relates to a spill-proof drink dispensing system and method.

BACKGROUND OF THE DISCLOSED TECHNOLOGY

Many different types of drink dispensers are well known in the art. Commercial dispensers, such as soda fountains, are fairly common in fast food restaurants and convenience stores. Such large-scale dispensers are usually powered by electricity and require the use of carbon dioxide tanks. The convenience of these dispensers is reflected in lower costs to the seller, as well as to the consumer. It is significantly less expensive to purchase a drink from a fountain than in form of a bottled or canned beverage.

More recently, smaller-scale drink dispensers have been created for at-home applications. Such machines can prove to be very handy, especially in homes with children. Oftentimes it can be difficult for young children to pour themselves a glass of juice from a bottle. The bottles may be rather bulky, which frequently leads to spilling when handled by a child. However, purchasing smaller sizes of particular beverages can prove costly, especially if there is a large demand for such a beverage.

Thus, home versions of drink dispensers have sought to alleviate this problem by providing a means for easily dispensing a beverage of choice. However, these dispensers come with problems of their own, as they are often expensive to maintain and clean. If they have filtering/mixing mechanisms, the pumps may become clogged and dirty. Moreover, they may be quite large and may require electricity and space that may not be available in a household kitchen. Their bulk prevents these dispensers from being transported or placed in a household refrigerator. Finally, these dispensers still may be difficult to operate for younger children. The automatic dispensing mechanism can inevitably lead to overfilling and spilling. Moreover, if the cup to be filled is not held at an appropriate height below a dispenser, the liquid may splash as it reaches the cup. Spilling and splashing can lead to slippery floor surfaces which are especially dangerous in households with young children.

Therefore, there is an unfulfilled need to provide a less expensive, less bulky drink dispenser that prevents spilling and may be used by people of all ages.

It is therefore an object of the disclosed technology to provide improved spill-proof drink dispensing devices and methods that are portable, easy to maintain, and child-proof.

SUMMARY OF THE DISCLOSED TECHNOLOGY

The disclosed technology described herein addresses a need, unfulfilled in the prior art, of providing a cost-effective system and method for dispensing drinks while avoiding splashing and spilling.

Accordingly, it is an object of the disclosed technology to provide a drink dispensing system with a locking spigot and lidded-cup arrangement that operates to dispense liquid without overflowing or spilling.

In an embodiment of the disclosed technology, an improved drink dispensing system is provided. The system's components include a container, a spigot, and a lid adapted to fit a corresponding cup. The spigot extends from an outside portion of the container, and comprises a lever, cylindrical nozzle, and cylindrical locking collar. The nozzle has a smaller diameter than the collar, and extends through the collar. The cylindrical collar has threads disposed along an interior surface thereof. The lever is in rotational communication with the collar, such that horizontal rotation of the lever causes horizontal rotation of the collar along a common axis of rotation.

The lid has a cylindrical spout extending vertically upwards from a top surface thereof, the spout being hollow and providing access to the interior of the corresponding cup. An exterior surface of the spout has threads that correspond to the threads of the interior surface of the collar.

In embodiments of the disclosed technology, the lid is matable to the spigot such that the nozzle extends into the spout towards the interior of the cup. When mated, the collar surrounds the exterior of the spout. Rotation of the lever causes the threads of the collar to engage the threads of the spot. This causes the lid to become releasably affixed to the spigot for purposes of leak-free dispensing of the liquid from the container.

In further embodiments, the lid may have a flip cap adapted to cover the spout. The drink dispensing system may also have a cup dispenser mounted to an outside portion of the container. The cup dispenser may employ a spring-loaded mechanism for dispensing cups therefrom.

In still further embodiments of the disclosed technology, the system may comprise a mixing rake for manually mixing the liquid in the container, the mixing rake having a generally planar mixer head with cutouts disposed therein. A narrow rod extends perpendicularly from the mixer head out of the container to a grip. The grip is likewise perpendicularly affixed to the end of the rod. The grip is operable to move the mixer head back and forth within the container, thereby mixing the liquid.

In still further embodiments, the system may also employ a cooling tray adapted to hold a cooling medium such as ice or an ice pack, the container being adapted to rest on the cooling tray in order to keep the liquid inside the container cool. The container and cooling tray may rest upon a spill-catching tray. The spill-catching tray may be longer than the container, and is adapted to allow the container to slide longitudinally forward and backward thereon, such that the spigot rests over the tray when the drink dispensing system is not in use. When the dispenser is used, it will be slid forward on the tray, such that the spigot extends beyond the edge of the tray in order to allow a cup to be mounted to the spigot.

In another embodiment of the disclosed technology, a kit is provided. The kit's components include a container, a spigot, and a lid adapted to fit a corresponding cup. The spigot extends from an outside portion of the container and comprises a lever, cylindrical nozzle, and cylindrical locking collar. The nozzle has a lesser diameter than the collar, and extends through the collar. The cylindrical collar has threads disposed along an interior surface thereof. The lever is in rotational communication with the collar, such that horizontal rotation of the lever causes horizontal rotation of the collar along a common axis of rotation.

The lid has a cylindrical spout extending vertically upward from a top surface thereof, the spout being hollow and providing access to the interior of the corresponding cup. An exterior surface of the spout has threads that correspond to the threads of the interior surface of the collar. The lid can be mated to the spigot, such that the nozzle extends into the spout towards the interior of the cup. When mated, the collar surrounds the exterior of the spout. Rotation of the lever causes the threads of the collar to engage the threads of the spot. This causes the lid to become releasably affixed to the spigot in a manner that allows easy release, for purposes of leak-free dispensing of the liquid from the container.

The kit may employ a cooling tray adapted to hold a cooling medium such as ice or an ice pack, the container being adapted to rest on the cooling tray in order to keep the liquid inside the container cool. The container and cooling tray may rest upon a spill-catching tray. The spill-catching tray being longer than the container, and adapted to allow the container to slide longitudinally forward and backward thereon, such that the spigot rests over the tray when the dispenser is not in use. When the dispenser is used, it will slide forward on the tray, such that the spigot extends beyond the edge of the tray in order to allow a cup to be mounted to the spigot.

In further embodiments, the kit may employ a mixing rake for manually mixing the liquid in the container, the mixing rake having a generally planar mixer head with cutouts disposed therein. A narrow rod extends perpendicularly from the mixer head out of the container to a grip. The grip is likewise perpendicularly affixed to the end of the rod. The grip is operable to move the mixer head back and forth within the container, thereby mixing the liquid.

In still further embodiments, the lid may have a flip cap adapted to cover the spout. The kit may also have a cup dispenser mounted to an outside portion of the container. The cup dispenser may employ a spring-loaded mechanism for dispensing cups therefrom. Alternatively, the kit may have a snack tray mounted to a top portion of the container.

In yet another embodiment of the disclosed technology, a method is provided for dispensing a liquid into a cup without spilling the liquid. The first step of the method involves fastening a lid to a cup, the lid having a threaded spout. The next step involves engaging the threaded spout to a threaded nozzle portion of the spigot, the spigot being extended from an outside portion of a container which stores liquid to be dispensed by the drink dispenser. Next, the lever is twisted in order to thread the spout to the nozzle using the provided threads, with the lever in direct fixed rotational communication with the collar surrounding the nozzle. Continuing with the method, the lever is pulled vertically to open the spigot. This causes the contents of the container to dispense into the cup.

In a further embodiment of the disclosed method, an additional step may be provided of returning the lever to its horizontal position to close the spigot, and then turning the lever counter clockwise to release the cup from the grasp of the collar. In further embodiments of the disclosed technology, the lever may thread the spout to the collar and begin dispensing liquid all in one action.

A better understanding of the disclosed technology will be obtained from the following detailed description of embodiments of the disclosed technology taken in conjunction with the drawings.

DETAILED DESCRIPTION OF EMBODIMENTS OF THE DISCLOSED TECHNOLOGY

The presently disclosed technology is a system, kit and method for dispensing liquid. The system is generally composed of a container with dispensing spigot and a corresponding lid placed on a cup. The lid can be mated to the spigot by way of a threaded cylindrical connection. Rotation of a lever on the spigot causes the lid (and therefore the cup) to be affixed in a releasable manner to the spigot in order for liquid to be dispensed, without leakage, into the cup.

Figure 1:
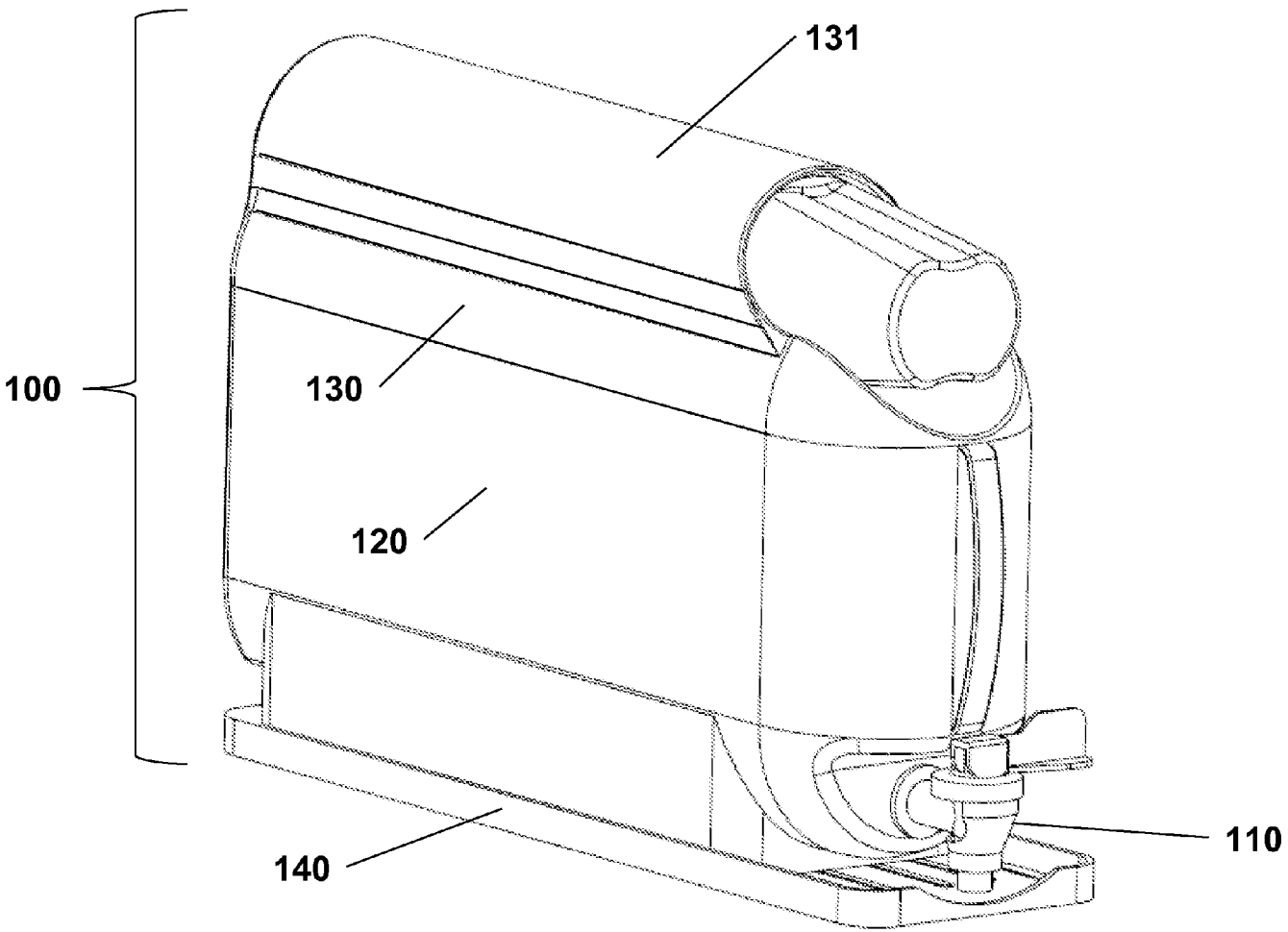
FIG. 1 is a perspective view showing a drink dispenser of an embodiment of the disclosed technology.

Referring now to the figures, FIG. 1 is a perspective view showing a drink dispenser of an embodiment of the disclosed technology. A drink dispenser 100 is shown. The drink dispenser 100 is generally comprised of a container or vessel 120 (herein "container"), and a spigot or valve 110 (herein "spigot"). The container 120 may be any vessel or tank adapted to hold liquid therein. The container 120 has a removable top or cap for refilling the container with liquid. The spigot 110 may generally be any valve or tap for dispensing liquid. The spigot 110 will be described in greater detail with reference to FIGS. 2 through 4.

The drink dispenser 100 rests on a drip catching tray 140. The tray 140 has raised edges around its perimeter in order to hold spilled liquid therein. The tray 140 is adapted to allow the drink dispenser 100 to slide forward and back thereon. This is made possible by longitudinal tracks or slats in the tray 140 which mate with corresponding grooves on the base of the drink dispenser 100, thereby allowing for movement of the drink dispenser along one axis. FIG. 1 shows the drink dispenser 100 in its 'storage' position with respect to the tray 140. This is the resting position of the drink dispenser 100 when it is not in use. In this position, the spigot 110 rests directly above the tray 140, so that any excess that may drip from the spigot 110 will drop onto the tray. When the drink dispenser 100 is to be used, it is simply slid forward on the tray 140, so that the spigot 110 extends beyond the edge of the tray. This configuration allows for easier use when the drink dispenser 100 is stored on a refrigerator shelf or a kitchen counter.

Referring still to FIG. 1, a cover 130 of the container 120 may also be adapted into a cup holder 131 for storing extra cups. The whole cover 130, cup holder 131 included, may be removed from the container 120 in order to refill the container with liquid. The cup holder 131 may be any spring-loaded adjustable cylinder for storing and dispensing cups. Alternatively, a snack tray (not shown) may be mounted to a top portion of the container 120. In this embodiment, the cover 130 may be adapted into the snack tray such that the cover, snack tray included, may be removed from the container 120.

Figure 2:
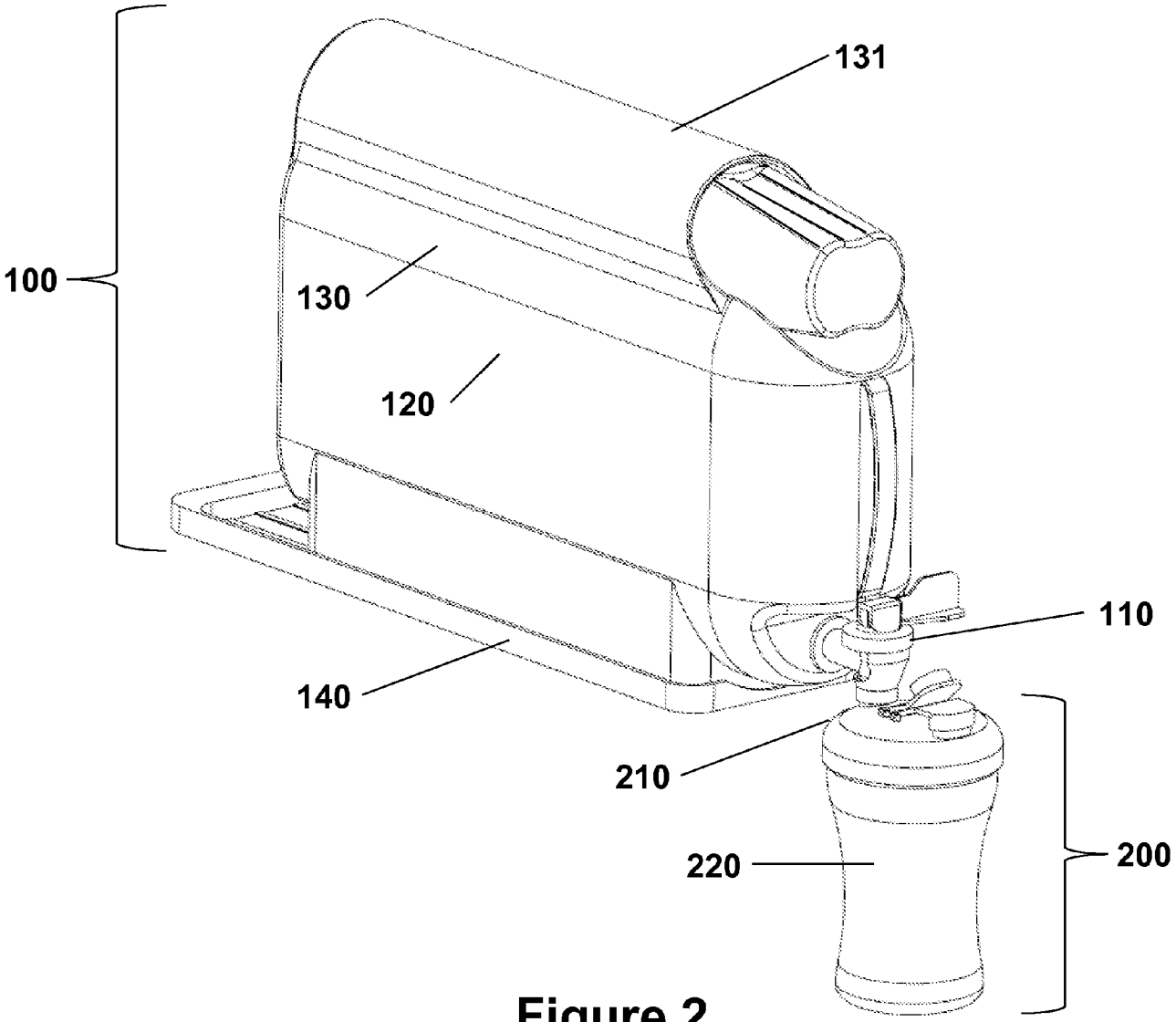
FIG. 2 is a perspective view showing a drink dispensing system of an embodiment of the disclosed technology.

FIG. 2 is a perspective view showing a drink dispensing system of an embodiment of the disclosed technology. As shown, a drinking vessel 200 is abutted and engaged to the spigot 110. The drinking vessel 200 generally comprises a cup 220 and a lid 210. For the purposes of this specification, any reference to "drinking vessel" will be referring to the cup and lid collectively. The lid 210 is specially adapted to engage with the corresponding spigot 110. The details of this configuration will be discussed in greater detail with respect to FIGS. 3 and 4. The cup 220 may be any type of drinkware known in the art. The lid 120 is the point of contact with the drink dispenser 100, and may be adapted to cover any type of cup. It is also envisioned that instead of a cup, a water bottle, flask, NALGENE bottle, canteen, or any other type of vessel for carrying liquid may be employed by the presently disclosed technology.

Referring still to FIG. 2, the drink dispenser 100 is shown in its operating position, that is, it has been slid forward on the tray 140. In this position, the spigot 110 extends beyond the edge of the tray 140, such that a drinking vessel 200 can comfortably be abutted to the spigot. Thus, the drink dispenser 100 may be safely placed on an edge of a surface without a portion thereof hanging over the edge, thereby reducing the risk of the dispenser falling off of the surface.

Figure 3A:
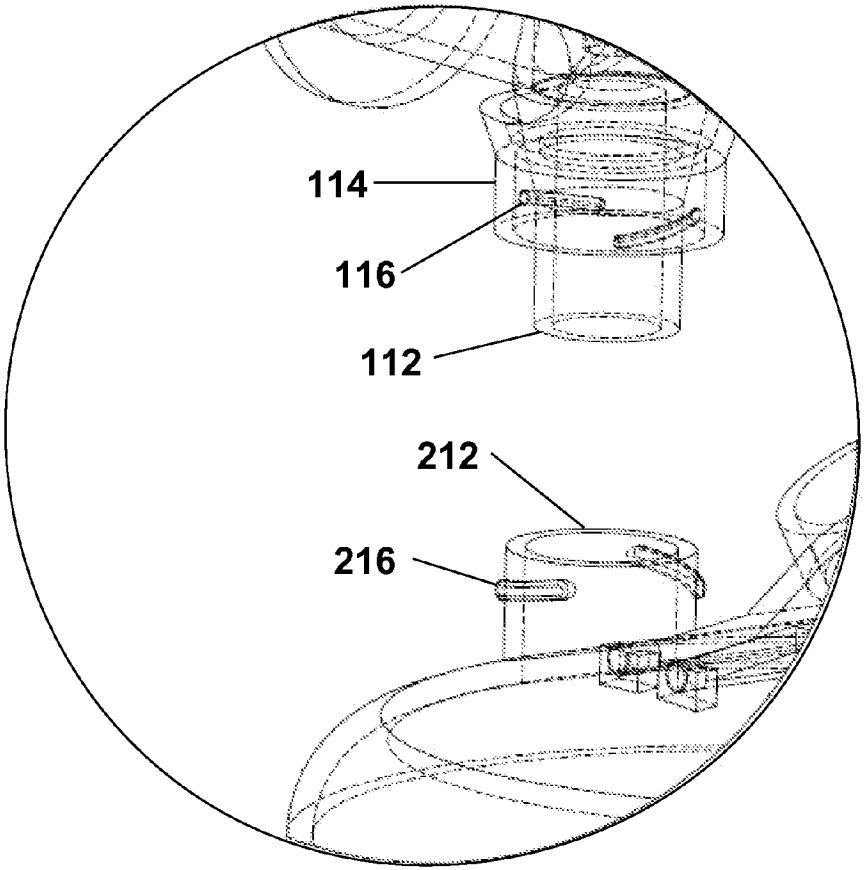
FIG. 3*a* is a close up schematic view of the spigot and lid arrangement of section A of FIG. 3.
Figure 3:
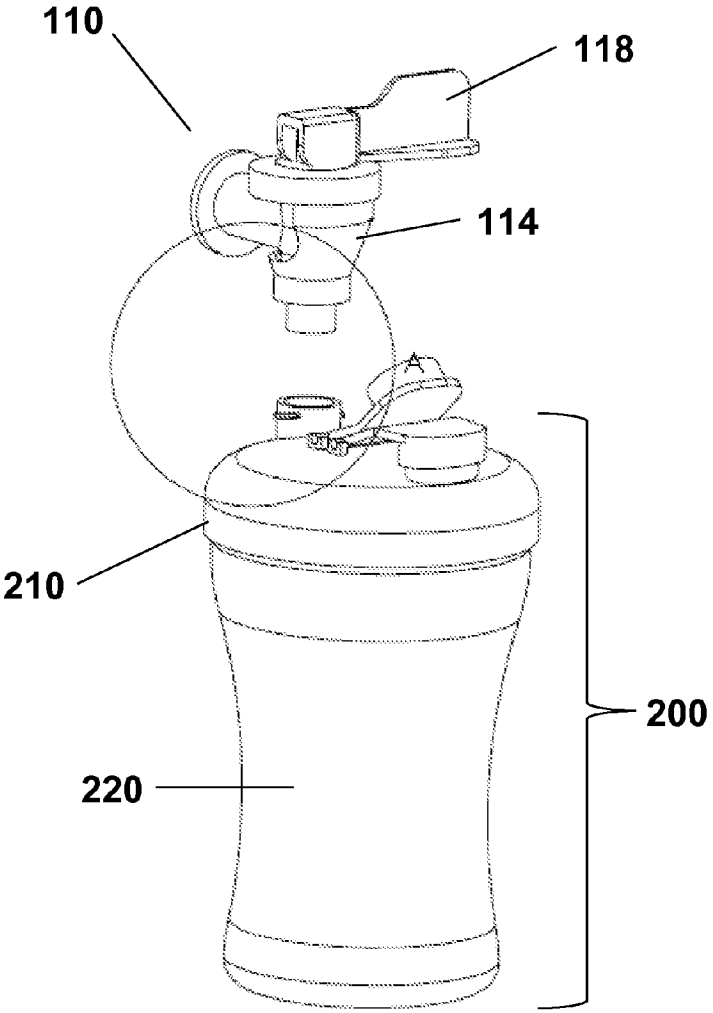
FIG. 3 is a perspective view of a spigot and lid arrangement of an embodiment of the disclosed technology.

FIG. 3 is a perspective view of a spigot and lid arrangement of an embodiment of the disclosed technology. The drinking vessel 200 is shown lined up in a position directly below the spigot 110. As shown, the lid 210 and the cup 220 are distinct portions. As previously alluded to, the cup 220 may be interchangeable with any other type of drinkware. The spigot 110 is also shown in greater detail. Visible are a lever 118 and collar 114 portions of the spigot 110. The lever 118 operates to control the dispensing of liquid from the drink dispenser as well as the engaging of the lid 210 to the spigot 110 just prior to dispensing. The lever 118 is in fixed rotational communication with the collar 114, such that when the lever is twisted, the collar twists along with it. The lever 118 (and therefore the collar 124) has a rotational freedom of 90 degrees, thus allowing it to be turned one-quarter the way around.

FIG. 3*a* is a close up schematic view of the spigot and lid arrangement of section A of FIG. 3. As shown, the details of the lid 210 and spigot 110 become clear. The portions of the Figure with dotted lines are those parts of the spigot 110 and lid 210 that are not visible from a perspective view. Beginning with the lid 210, a cylindrical spout 212 is shown extending vertically upwards from the top surface of the lid. The spout 212 may be of any diameter, as long as it is compatible with the spigot 110. The spout 212 has threads 216 disposed on a side exterior surface thereof. In embodiments of the disclosed technology, two opposing threads 216 may run one-quarter of the way around the outer circumference of the cylindrical spout 212.

Referring now to the spigot 110, a nozzle 112 and collar 114 are shown. The nozzle 112 is the cylindrical portion of the spigot 110 through which the liquid is dispensed. The diameter of the nozzle 112 is less than the diameter of the spout 212, so that the nozzle can be inserted into the spout. The nozzle 112 is disposed through the collar 114. Visible in this Figure are the threads 116 disposed on the interior surface of the collar 114. The diameter of the collar 114 itself is larger than the spout 212, so that the spout can be inserted into the collar (and thus around the nozzle 112).

Operation of the drink dispenser involves abutting the spout 212 portion of the lid 210 up to the spigot 110, such that the nozzle 112 rests inside of the spout, and the collar 114 surrounds the exterior of the spout. When the lid 210 is abutted to the spigot 110, the configuration of the threads 116 and 216 is such that they will not come into contact with one another. That is, the drinking vessel 200 is abutted to the spigot 110 with the spout 212 in the "12 o'clock" position when viewed from above. In the embodiment shown, this arrangement precludes the threads 216 of the spout from coming into contact with the threads 116 of the collar 114 upon insertion of the spout 212. However, when the collar 114 is rotated, the threads become engaged, thereby removably affixing the lid 210 to the spigot 110. The dynamics of this process will be described with respect to FIGS. 4*a* through 4*c*.

Figure 4C:
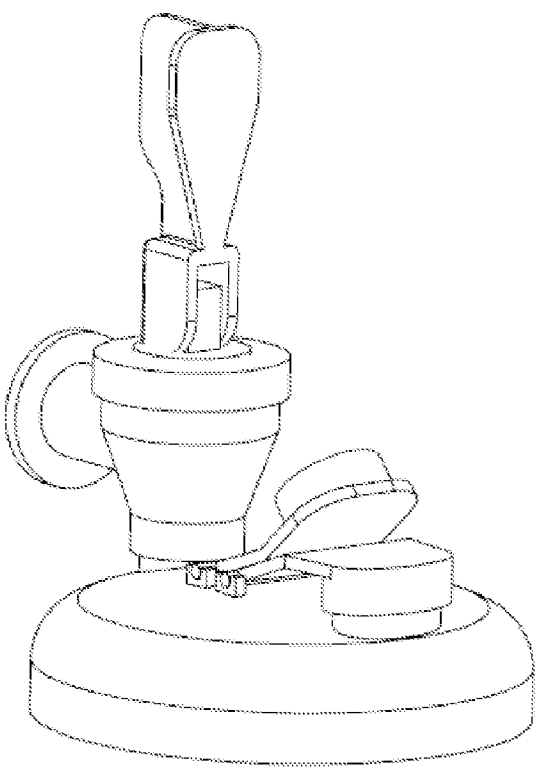
FIG. 4*c* is a close up perspective view of the spigot of FIG. 4*b* with its lever in the dispensing position.
Figure 4B:
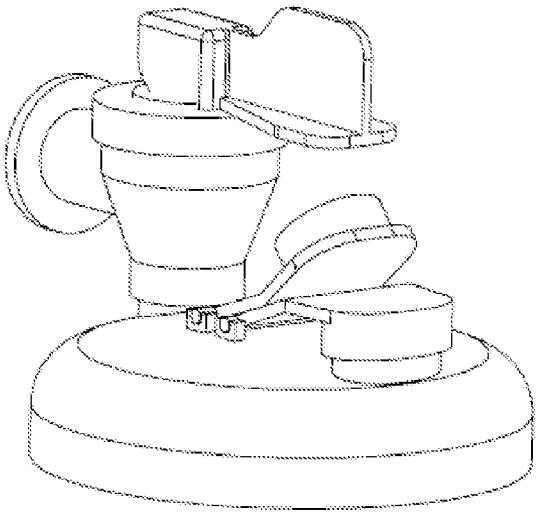
FIG. 4*b* is a close up perspective view of the spigot of FIG. 4*a* with its lever in the engaged position.
Figure 4A:
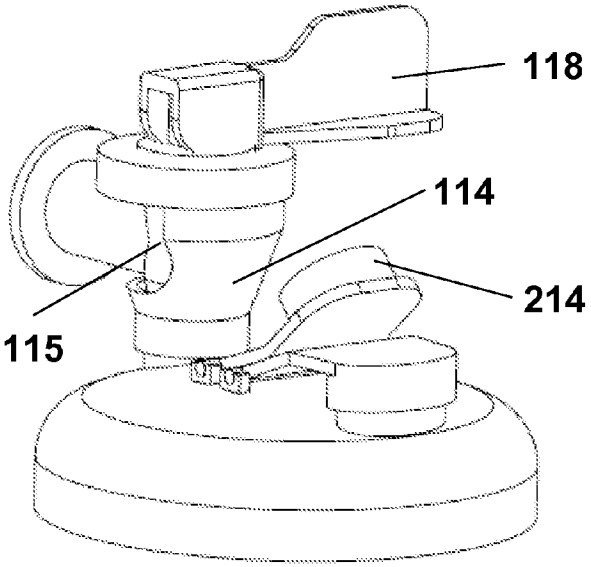
FIG. 4*a* is a close up perspective view of a spigot with its lever in the disengaged position.

FIG. 4*a* is a close-up perspective view of a spigot with its lever in the disengaged position. In this Figure, the lid 210 has been abutted to the spigot 110. The spout 212 is disposed between the collar 114 and nozzle 112. In its current position, the lid with accompanying cup (not shown) is presumably being held up to the spigot 110 by a user because a locking mechanism has not been engaged just yet. A cut-out 115 is provided in a portion of the collar 114. The purpose of the cut-out 115 is so that the collar 114 can be rotated clockwise by the lever 118 without inhibition. A flip cap 214 is also provided on the lid 210 for covering the spout 212 when not in use.

FIG. 4*b* is a close-up perspective view of the spigot of FIG. 4*a*, with its lever in the engaged position. In this position, the collar 114 has been rotated by operation of the lever 118 being moved a one-quarter turn clockwise. In this view, the cut-out 115 is no longer visible due to the rotation. The lid 210 is now secured to the spigot 110 due to their respective threads being engaged. When the collar 114 is turned, the threads make contact with each other, and the lid 210 is now affixed in an easy to release manner to the spigot 110. Theoretically, with the lever in this position, the user need not hold the drinking vessel 200 up to the spigot 110, as it is temporarily fixed in place. The threads effectively prevent gravity from causing the drinking vessel 200 to become detached and fall from the spigot 110.

FIG. 4*c* is a close-up perspective view of the spigot of FIG. 4*b* with its lever in the dispensing position. In this position, the spigot 110 valve is released, thereby allowing liquid to drop by gravity from the container into the drinking vessel. The lifting of the lever 118 raises an interior washer to allow flow through the spigot 110 and nozzle 112. At this point, liquid begins to fill the drinking vessel 200. The drinking vessel 200 and the drink dispenser 100 now form a closed system which effectively prevents air or liquid from escaping, thus forming a vacuum. As such, it is not possible for a leak or spill to occur while liquid is being dispensed. As the drinking vessel 200 fills up, air from inside the cup is displaced by the incoming liquid and, therefore, through the spigot 110 into the container. As this happens, bubbles resulting from the displaced air may be seen and heard by the user as they enter the container. When the bubbles can no longer be seen or heard, it signifies to the user that the drinking vessel 200 is full, and the lever can be returned to its horizontal position. Because of the closed connection between the spigot and the lid, the drinking vessel 200 cannot be overfilled. Once the drinking vessel 200 has finished filling up, the movement of liquid through the spigot 110 ceases and the lever can be closed. Once returned to its horizontal position, the lever 118 can be rotated counter-clockwise, in order to release the lid 210 from the spigot 110. The arrangement of the nozzle being disposed within the spout also prevents any liquid that may be present within the nozzle from spilling when the spigot is closed.

Figure 5:
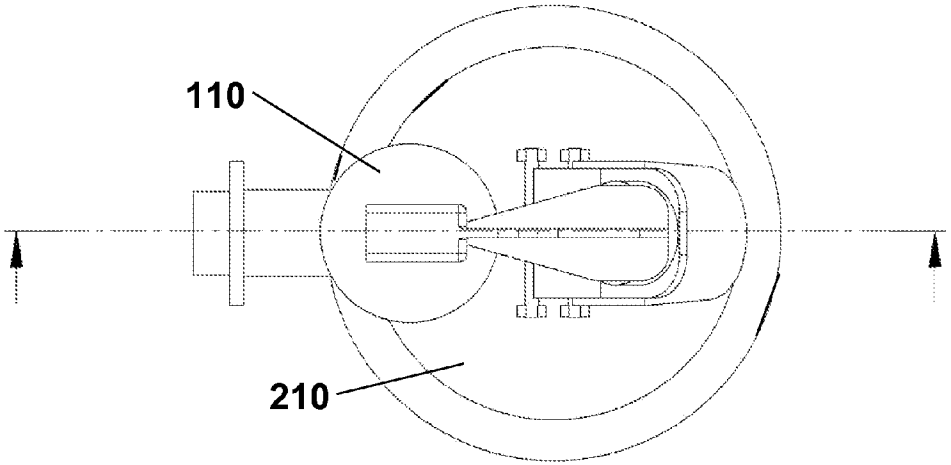
FIG. 5 is a top plan view of the spigot of FIG. 4*b*.

FIG. 5 is a top plan view of the spigot of FIG. 4*b*. The spatial positioning of the lid 210 with respect to the spigot 110 becomes apparent in this Figure. When abutted to the drink dispenser, the spout 212 resides at the portion of the lid 210 that is closest to the spigot 110. Lining up the lid 210 in this fashion ensures that the spout 212 can be mated to the spigot 110 without interference by the threads.

Figure 5A:
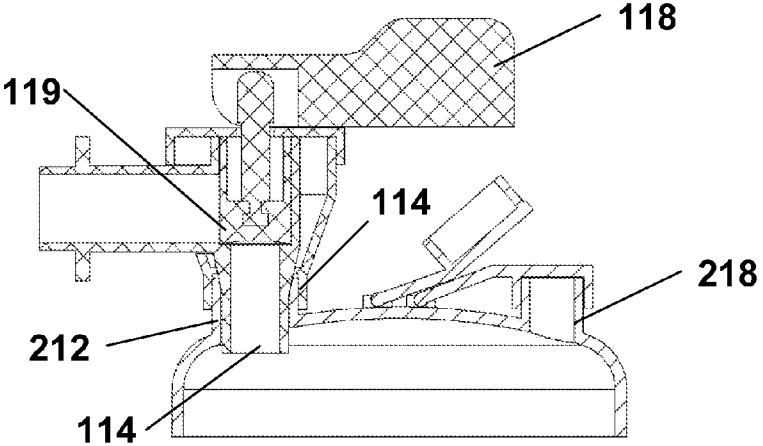
FIG. 5*a* is a cross-sectional side elevation view along the A-A axis of FIG. 5.

FIG. 5*a* is a cross-sectional side elevation view along the A-A axis of FIG. 5. In this Figure, the lid 210 is affixed to the spigot 110 because the lever 118 has been turned 90 degrees, as described with reference to FIG. 4*b*. The nozzle 114 is disposed through the spout 212 and into the interior of the drinking vessel 200. This ensures that all of the dispensed liquid drops directly into the drinking vessel 200. The collar 114 surrounds the spout 212, creating an airtight seal using the threads. To dispense the liquid, the lever 118 is raised to a vertical position. This causes an internal washer 119 to be raised, thereby opening a passage through which the liquid may flow through the spigot, out of the nozzle, and into the drinking vessel. Through this same passage, air travels in the opposite direction out of the drinking vessel 200 and into the container via the spigot as it is displaced by the dispensed liquid.

Referring still to FIG. 5*a*, a second spout 218 is provided on the lid 210. This second spout 218 may be of a diameter different from that of the threaded spout 212. It may be used for adapting to spigots of drink dispensers of other sizes. Alternatively, it may be used for sanitary drinking out of the drinking vessel 200 in order to maintain cleanliness. In other words, the threaded spout 212 may be used strictly for refilling the drinking vessel 200, whereas the second spout 218 is strictly for drinking out of it. This arrangement may be advantageous for applications in which a number of persons are using the drink dispenser, in order to prevent the spread of germs.

Figure 6:
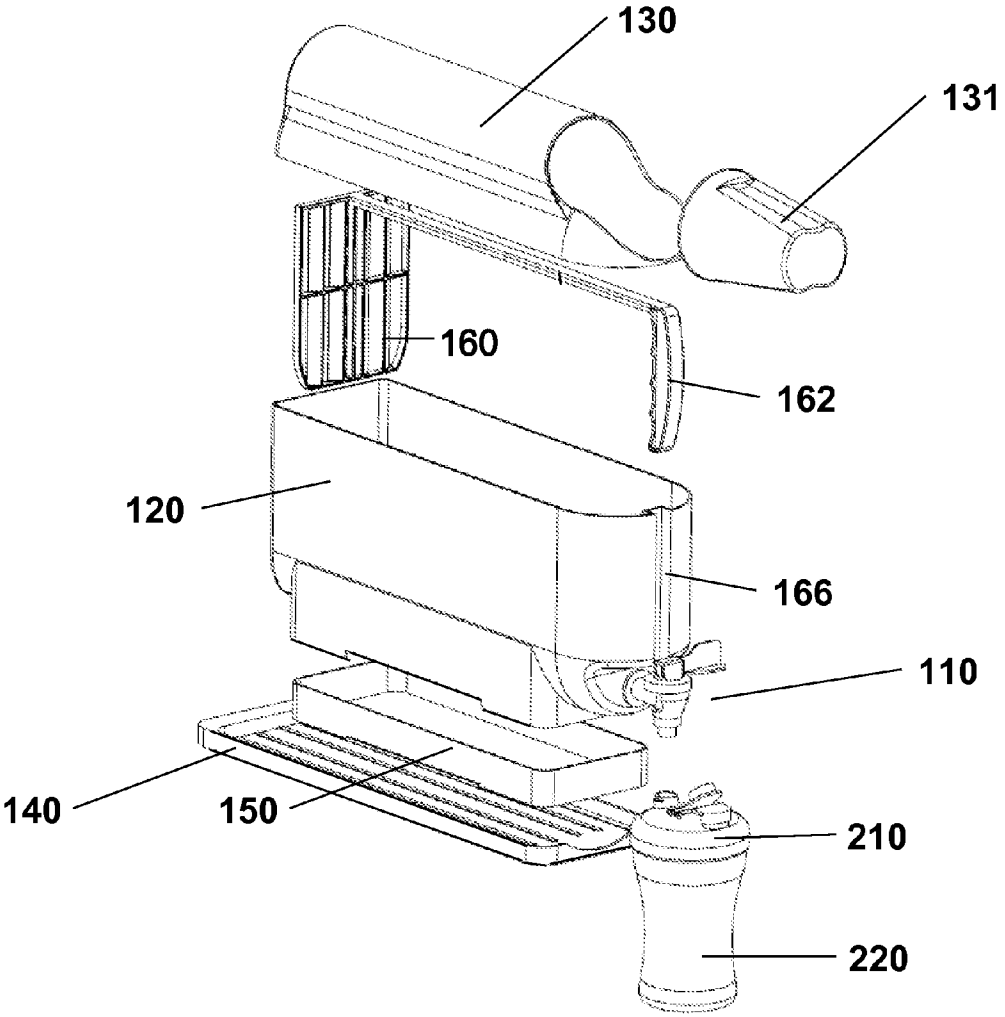
FIG. 6 is an exploded view of the drink-dispensing system shown in FIG. 2.

FIG. 6 is an exploded view of the drink dispensing system shown in FIG. 2. A cooling tray 150, according to further embodiments, is provided between the spill catching tray 140 and the base of the container 120. The cooling tray 150 is adapted to store loose ice or ice packs. The positioning of the cooling tray 150 ensures that the ice or ice packs are in direct contact with the base of the container 120, thereby keeping the liquid stored therein cold. The cooling tray 150 may fit flush within a void formed by the base of the container 120, thereby keeping any ice, melted ice, or ice packs in place when the drink dispenser is transported.

Also apparent in this Figure is a mixing rake 160 for manually mixing the liquid stored in the vessel. The mixing rake 160 allows the liquid to be mixed without requiring access to the container 120.

Figure 7:
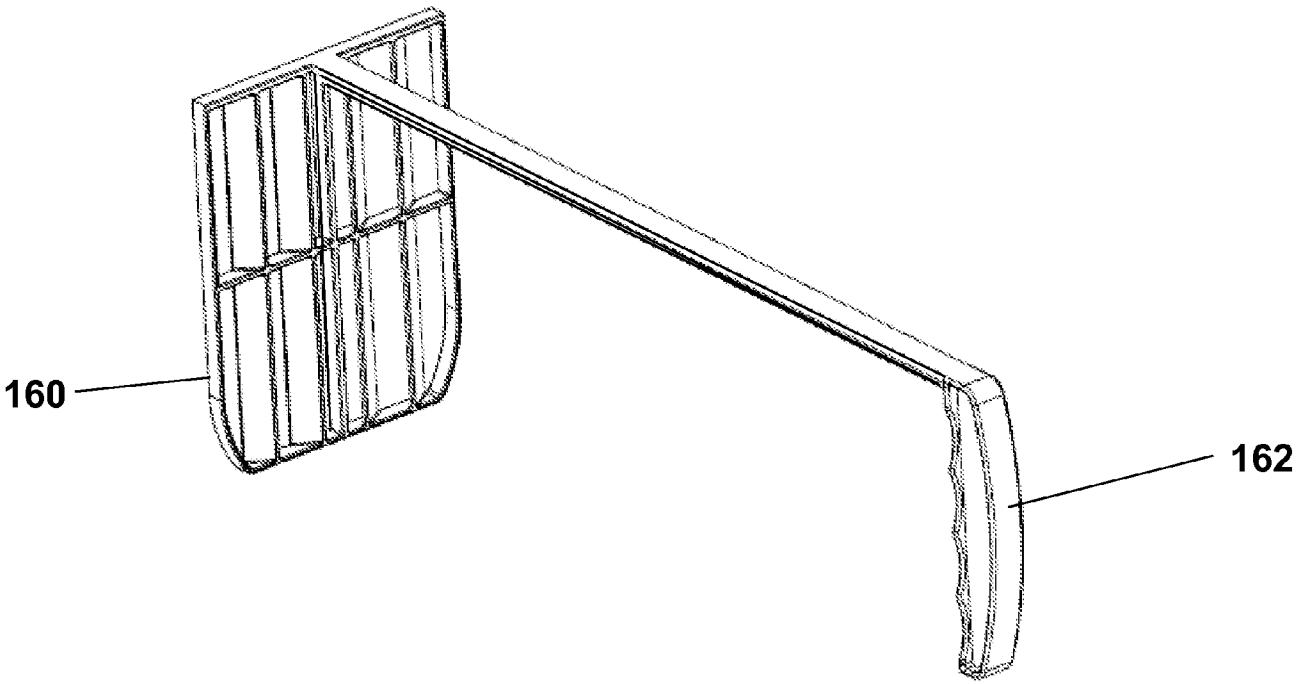
FIG. 7 is a stand-alone perspective view of the mixing rake of FIG. 6.

FIG. 7 is a stand-alone perspective view of the mixing rake of FIG. 6. The mixing rake 160 has a generally planar rigid mixer head with cut-outs disposed therein. The cross-section of the mixer head is fitted to the inner contours of the container. A narrow rod extends perpendicularly from a portion of the mixer head. The rod puts the mixer head in direct, fixed communication with a grip disposed on the exterior of the container. The grip is perpendicularly affixed to an end of the rod, which extends out of the container.

Referring back to FIG. 6, the grip is operable to move the mixer head back and forth within the container in order to mix its contents. The grip may be pulled away from the container until the mixer head reaches the front of the container, thereby preventing it from being pulled any further. Because the mixer head hugs the contours of the container's interior, it ensures that no particles in the liquid can settle or stick to the sides of the container. Moreover, an aperture through which the rod extends out of the container bears the same cross-section as the rod, in order to prevent liquid from escaping from the container. In further embodiments, the rod may have an I-beam cross-section. Furthermore, the aperture through which the rod extends out of the container may be constructed of rubber, so that liquid cannot easily escape. A narrow recess 166 may also be provided in the front portion of the container for storing the grip when the mixing rake is not being used. Thus, after mixing the contents of the container, the user may simply push the grip forward, so that the grip rests within the recess.

Figure 8:
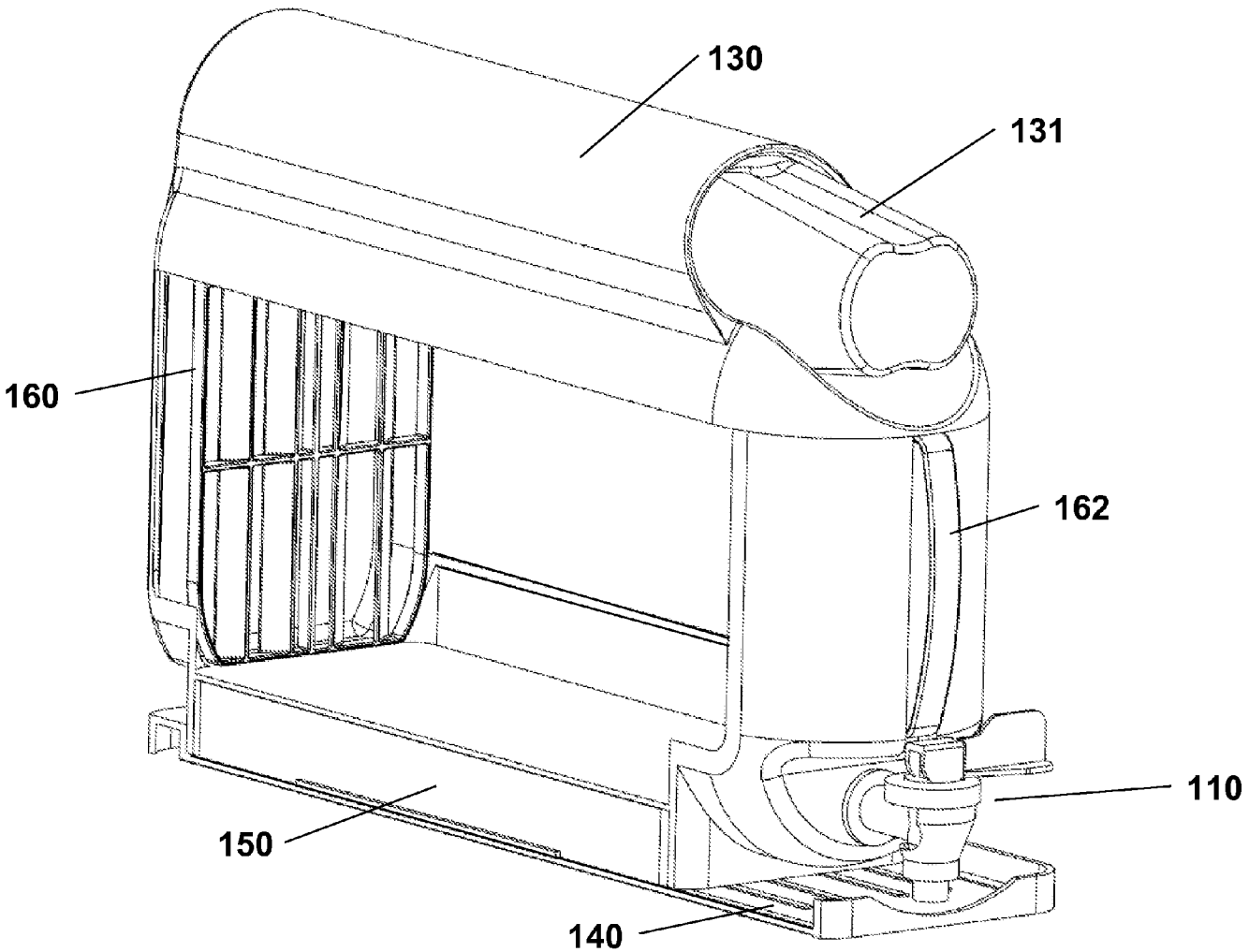
FIG. 8 is a partial cut-away assembled view of the drink dispenser shown in FIG. 6.
Figure 9:
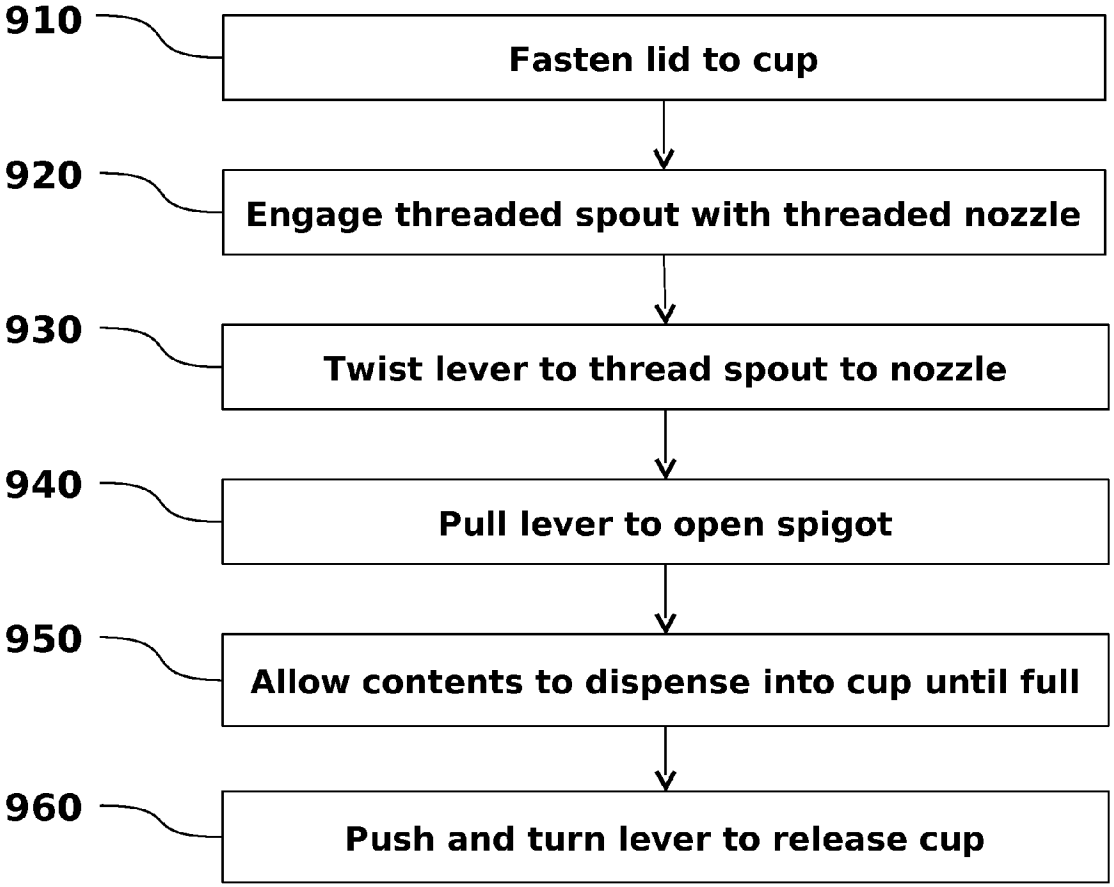
FIG. 9 is a flow diagram outlining steps of a drink-dispensing method of embodiments of the disclosed technology.

FIG. 8 is a partial cut-away assembled view of the drink dispenser shown in FIG. 6. This view shows the mixing rake 160 in its stored position. The grip 162 is shown to be flush within the narrow recess of the front portion of the container. Because the rod is of equal length to that of the container, the mixer head rests along the back interior wall of the container. In this resting position, the exterior grip of the mixing rake is unassuming and blends in aesthetically with the exterior of the drink dispenser FIG. 9 is a flow diagram outlining steps of a drink dispensing method of embodiments of the disclosed technology. The method begins in step one 900 with the fastening of a lid to a cup, the lid having a cylindrical spout with threads along its exterior. Step two 920 involves engaging the threaded spout to a threaded nozzle/collar portion of the spigot, the spigot extending from an outside portion of a container, and the container storing liquid to be dispensed by the drink dispenser. Next, the lever is twisted 930 in order to affix the spout to the nozzle using the provided threads. The lever is in direct fixed rotational communication with the collar surrounding the nozzle. Therefore when the lever is turned, the collar is caused to turn, thereby catching and engaging the threads. At this point a leak-proof seal is created between the spigot and the lid. Continuing with the method, the lever is pulled vertically to open the spigot 940. This causes the contents of the container to dispense into the cup until the cup is full 950. Finally, the lever is returned to its horizontal position to close the spigot, and then turned counter-clockwise to release the cup from the grasp of the collar 960. In further embodiments of the disclosed technology, the lever may thread the spout to the collar and begin dispensing liquid all in one motion.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described hereinabove are also contemplated and within the scope of the invention.

We claim:

1. An improved drink dispensing system comprising:

a container;

a spigot extending from an outside portion of said container, said spigot comprising a lever, a cylindrical nozzle, and a cylindrical locking collar;

said nozzle being of a lesser diameter of, and extending through, said collar, an interior surface of said collar having threads;

said lever being in rotational communication with said collar, such that horizontal rotation of said lever causes horizontal rotation of said collar along a common axis of rotation; and a lid, adapted to fit a corresponding cup, said lid comprising a cylindrical spout extending vertically upwards from a top surface of said lid, an exterior surface of said spout having threads correspond to said threads of said interior surface of said collar;

said lid mates to said spigot, such that said nozzle extends into said spout; and said collar surrounds said exterior of said spout;

wherein horizontal rotation of said lever causes said threads of said collar to engage with said threads of said spout, thereby releasably affixing said lid to said spigot for dispensing of said liquid;

wherein vertical rotation of said lever causes fluid to dispense from the container and;

wherein said lever is restricted from dispensing fluid unless said lid is releasably affixed to said spigot.

2. The drink dispensing system of claim 1, wherein said lid further comprises a flip cap adapted to cover said spout.

3. The drink dispensing system of claim 1, further comprising a cup dispenser mounted to an outside portion of said container.

4. The drink dispensing system of claim 1, further comprising a mixing rake for manually mixing said liquid in said container, said mixer comprising:

a generally planar rigid mixer head with cut-outs disposed therein, said mixer head disposed inside said container;

a narrow rod extending perpendicularly from a portion of said mixer head, said rod extending out of said container; and a grip perpendicularly affixed to an end of said rod that extends out of said container, said grip operable to move said mixer head back and forth within said container, thereby mixing said liquid.

5. The drink dispensing system of claim 4 further comprising a cooling tray adapted to hold a cooling medium, said container adapted to rest on top of said cooling tray.

6. The drink dispensing system of claim 5, further comprising a spill-catching tray adapted to hold said cooling tray and said container.

7. The drink-dispensing system of claim 6, wherein said spill catching tray is longer than said container, and is adapted to allow said container to slide longitudinally forward and backward thereon, such that said spigot rests over said tray when said drink dispensing system is not in use.

8. The drink dispensing system of claim 1, wherein said horizontal rotation of said lever is 90 degrees.

9. An improved drink dispensing system comprising:

a container;

a spigot extending from an outside portion of said container, said spigot comprising a lever, a cylindrical nozzle, and a cylindrical locking collar;

said nozzle being of a lesser diameter of and extending through said collar, an interior surface of said collar having threads;

said lever being in rotational communication with said collar, such that horizontal rotation of said lever causes horizontal rotation of said collar along a common axis of rotation; and a lid, adapted to fit a corresponding cup, said lid comprising a cylindrical spout extending vertically upwards from a top surface of said lid, an exterior surface of said spout having threads correspond to said threads of said interior surface of said collar;

said lid being matable to said spigot such that said nozzle extends into said spout;

said collar surrounding said exterior of said spout; and said lever being movable between three positions:

a first position being closed without said lid mated thereto;

a second position being horizontally rotated from said first position such that said threads of said collar are engaged with said threads of said spout, thereby releasably affixing said lid to said spigot; and a third position wherein said lever is pulled vertically to cause dispensing of liquid, said lever only movable into said third position from said second position.

10. The drink dispensing system of claim 9 further comprising a spill-catching tray adapted to hold said container, wherein said tray is longer than said container, and is adapted to allow said container to slide longitudinally forward and backward thereon, such that said spigot rests over said tray when said drink dispensing system is not in use.

11. The drink dispensing system of claim 10 further comprising a cooling tray adapted to hold a cooling medium, said container adapted to rest on top of said cooling tray.

12. The drink dispensing system of claim 9, further comprising a mixing rake for manually mixing said liquid in said container; said mixer comprising:

a generally planar rigid mixer head with cut-outs disposed therein, said mixer head disposed inside said container;

a narrow rod extending perpendicularly from a portion of said mixer head, said rod extending out of said container; and a grip perpendicularly affixed to an end of said rod that extends out of said container, said grip operable to move said mixer head back and forth within said container, thereby mixing said liquid.

13. The drink dispensing system of claim 9, wherein said lid further comprises a flip cap adapted to cover said spout.

14. The drink dispensing system of claim 9 further comprising a cup dispenser mounted to an outside portion of said container.

15. The drink dispensing system of claim 9, wherein said second position is horizontally rotated 90 degrees from said first position.

* * * * *